US010814620B1

(12) United States Patent
Praharaj et al.

(10) Patent No.: US 10,814,620 B1
(45) Date of Patent: Oct. 27, 2020

(54) SYSTEM AND METHOD FOR CLOSED LOOP REGULATION OF INK DROP VOLUMES IN A PRINTHEAD

(71) Applicant: Xerox Corporation, Norwalk, CT (US)

(72) Inventors: Seemit Praharaj, Webster, NY (US); Stuart A. Schweid, Pittsford, NY (US); Michael J. Levy, Webster, NY (US); John T. Newell, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/598,356

(22) Filed: Oct. 10, 2019

(51) Int. Cl.
*B41J 2/045* (2006.01)
*B41J 29/393* (2006.01)

(52) U.S. Cl.
CPC ..... *B41J 2/0456* (2013.01); *B41J 2/04558* (2013.01); *B41J 29/393* (2013.01); *B41J 2029/3935* (2013.01)

(58) Field of Classification Search
CPC ..... B41J 29/393; B41J 2029/3935; B41J 2/0456; B41J 2/04558
See application file for complete search history.

(56) References Cited

U.S. PATENT DOCUMENTS 6,618,158 B1 * 9/2003 Brown ..... B41J 29/393 358/1.13
2004/0075709 A1 4/2004 Gaston et al.
2005/0017999 A1 * 1/2005 Yoshida ..... G06K 15/102 347/6
2013/0222461 A1 * 8/2013 Kaszynski ..... H04N 1/4078 347/19
2015/0224763 A1 * 8/2015 Clippingdale ..... B41J 2/2128 347/11
2017/0087910 A1 * 3/2017 Nagashima ..... B41J 2/01
2018/0278758 A1 9/2018 Eggert et al.
2020/0005104 A1 * 1/2020 Fujimaki ..... G06T 1/00

* cited by examiner

*Primary Examiner* — Julian D Huffman
(74) *Attorney, Agent, or Firm* — Maginot Moore & Beck LLP

(57) ABSTRACT

A printer includes a plurality of printheads, a plurality of printhead drivers, and an optical sensor configured to generate image data of a substrate after the substrate has been printed by the plurality of printheads. A controller operates the printheads using the printhead drivers to print a pattern of ink drops on the substrate, determine from image data of the ink drop pattern received from the optical sensor whether a density response for the pattern of ink drops for each printhead is within a predetermined range about a reference density response for the pattern of ink drops, identify a peak voltage for each printhead determined to have the density response outside the predetermined range, and store the identified peak voltage in the printhead driver for the printhead. The printhead driver uses the identified peak voltage to generate firing signals for the printhead operatively connected to the printhead driver.

17 Claims, 7 Drawing Sheets

SYSTEM AND METHOD FOR CLOSED LOOP REGULATION OF INK DROP VOLUMES IN A PRINTHEAD

TECHNICAL FIELD

This disclosure relates generally to inkjet printers, and more particularly, to printheads having inkjets that are operated with firing signals.

BACKGROUND

Inkjet printers include one or more printheads that are operated to produce ink images on substrates. The printheads typically have an array of inkjets, which include transducers that receive firing signals to activate the transducers and eject a drop of ink from an inkjet. The average volume of an ink drop ejected from an inkjet in a printhead may vary significantly over the life of the printhead. This inconsistency in drop volume can arise from a number of factors such as printhead aging, variations in the viscosity of the ink supplied to a printhead, and the like. The inconsistency in drop volumes can adversely impact image quality. For example, a reduction in the expected ink drop volume may result in images appearing less saturated and an increase in expected drop volume may result in defects such as graininess and mottle. Ejecting ink drops having volumes that are different than the nominal volume can cause some inkjets to operate intermittently, eject significantly smaller ink drops, or cease operating completely. Detecting changes in the nominal volume of ejected ink drops on substrates and restoring the ability of the inkjets to eject ink drops at the nominal volume would be beneficial.

SUMMARY

A new printer is configured to detect changes in the nominal ink drop volume produced by a printhead outside a predetermined range and restore the ability of the printhead to eject ink drops having the nominal drop volume. The printer includes a plurality of printheads, each printhead being configured to eject ink drops onto a substrate as the substrate passes each printhead in a process direction, a plurality of printhead drivers, each printhead driver being configured to operate one of the printheads in the plurality of printheads in a one-to-one correspondence, an optical sensor configured to generate image data of the substrate after the substrate has passed the plurality of printheads, and a controller operatively connected to each printhead driver and the optical sensor. The controller is configured to operate each of the printheads using the printhead drivers to print a pattern of ink drops on the substrate, receive from the optical sensor the image data of the substrate, determine whether a density response for the pattern of ink drops for each printhead is within a predetermined range about a reference density response for a pattern of ink drops printed by each printhead at a predetermined time, identify a peak voltage for each printhead determined to have the density response outside the predetermined range, each peak voltage being identified using a peak voltage that was used to operate each of the printheads to print the pattern ink drops on the substrate, and store the identified peak voltage for each printhead having the density response outside of the predetermined range in the printhead driver corresponding to the printhead having the density response outside of the predetermined range so the printhead driver uses the identified peak voltage to generate firing signals for inkjets in the printhead operatively connected to the printhead driver.

A method of printer operation detects changes in the nominal ink drop volume produced by a printhead outside a predetermined range and restores the ability of the printhead to eject ink drops having the nominal drop volume. The method includes operating with a controller a plurality of printhead drivers that are operatively connected to a plurality of printheads in a one-to-one correspondence to operate each printhead in the plurality of printheads to print a pattern of ink drops on a substrate as the substrate passes each printhead in a process direction, generating with an optical sensor image data of the substrate after the pattern of ink drops has been printed on the substrate, determining with the controller whether a density response for the pattern of ink drops for each printhead is within a predetermined range about a reference density response for a pattern of ink drops printed by each printhead at a predetermined time, identifying with the controller a peak voltage for each printhead determined to have the density response outside the predetermined range, each peak voltage being identified using a peak voltage that was used to operate each of the printheads to print the pattern ink drops on the substrate, and storing with the controller the identified peak voltage for each printhead having the density response outside of the predetermined range in the printhead driver corresponding to the printhead having the density response outside of the predetermined range so the printhead driver uses the identified peak voltage to generate firing signals for inkjets in the printhead operatively connected to the printhead driver.

Another embodiment of the new printer includes a plurality of printheads, each printhead being configured to eject ink drops onto a substrate as the substrate passes each printhead in a process direction, a plurality of printhead drivers, each printhead driver being configured to operate one of the printheads in the plurality of printheads in a one-to-one correspondence, an optical sensor configured to generate image data of the substrate after the substrate has passed the plurality of printheads, and a controller operatively connected to each printhead driver and the optical sensor. The controller is configured to operate at a first time each of the printhead drivers to generate firing signals for each of the corresponding printheads in the plurality of printheads to form a first plurality of patches on the substrate for each printhead, each patch in the first plurality of patches formed by each printhead having a predetermined grayscale level, receive from the optical sensor image data of the first plurality of patches for each printhead on the substrate, store in a memory the image data for each patch in the first plurality of patches for each printhead on the substrate as a reference density response for each patch printed by each printhead at each predetermined grayscale level, operate at a second time that is subsequent to the first time each of the printhead drivers to generate firing for each of the corresponding printheads in the plurality of printheads to form a second plurality of patches on the substrate for each printhead, each patch in the second plurality of patches for each printhead being printed at the predetermined grayscale levels used to print the first plurality of patches for each printhead, receive from the optical sensor image data of the second plurality of patches on the substrate for each printhead, and determine whether a density response for each patch in the second plurality of patches for each printhead is within a predetermined range about the reference density response stored for each patch printed by each printhead at each predetermined grayscale level, determine a compensation parameter for each printhead that printed at least one patch in the second plurality of patches having the density response that is outside the predetermined range, and store the compensation parameter in the printhead driver corresponding to the printhead that printed the at least one patch in the second plurality of patches having the density response outside of the predetermined range.

BRIEF DESCRIPTION OF THE DRAWINGS

The foregoing aspects and other features of a printer that detects changes in the nominal ink drop volume produced by a printhead outside a predetermined range and restores the ability of the printhead to eject ink drops having the nominal drop volume are explained in the following description, taken in connection with the accompanying drawings.

DETAILED DESCRIPTION

Figure 1:
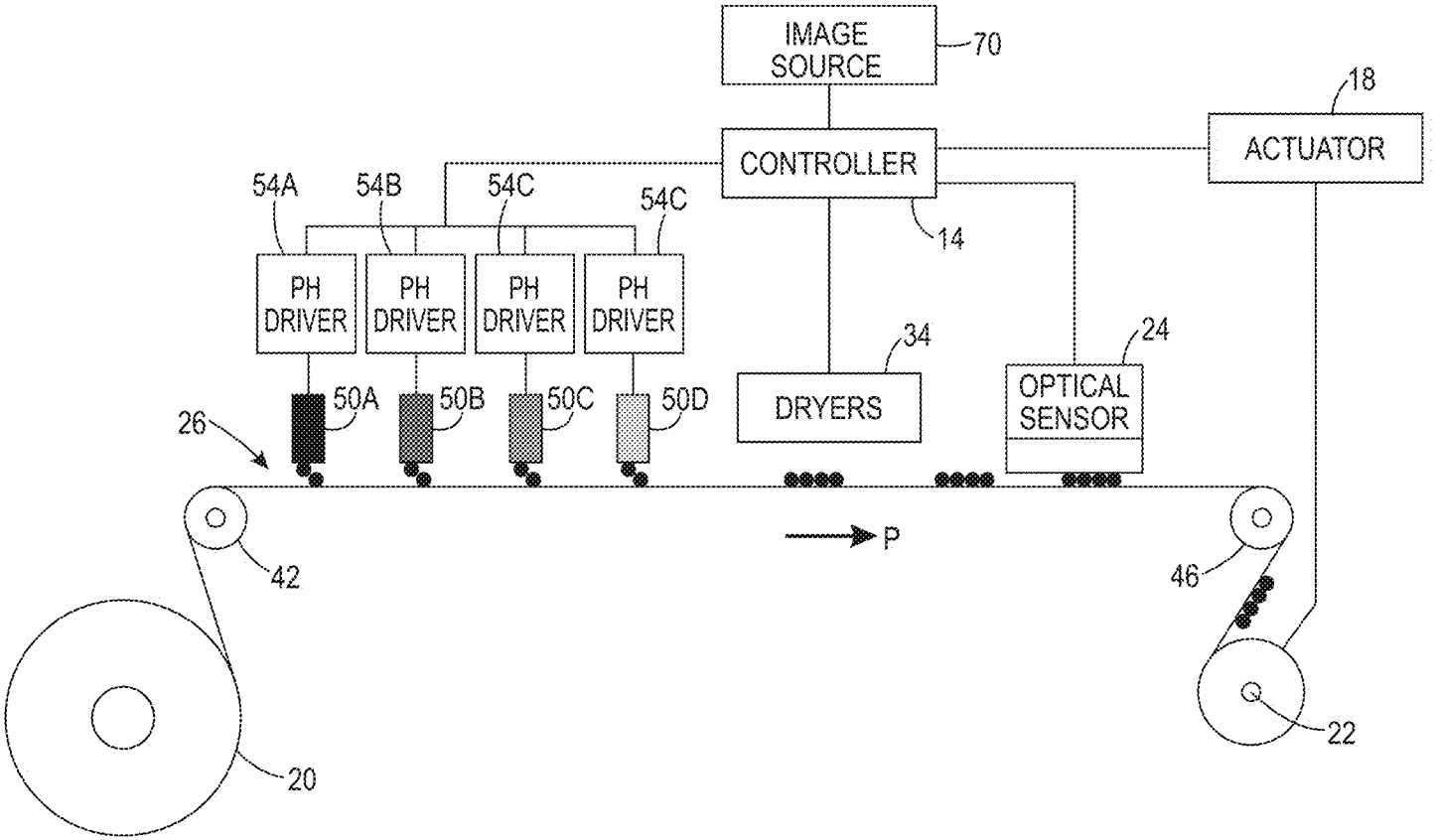
FIG. 1 is a diagram of a printer that detects changes in the nominal ink drop volume produced by a printhead outside a predetermined range and restores the ability of the printhead to eject ink drops having the nominal drop volume.
Figure 2A:
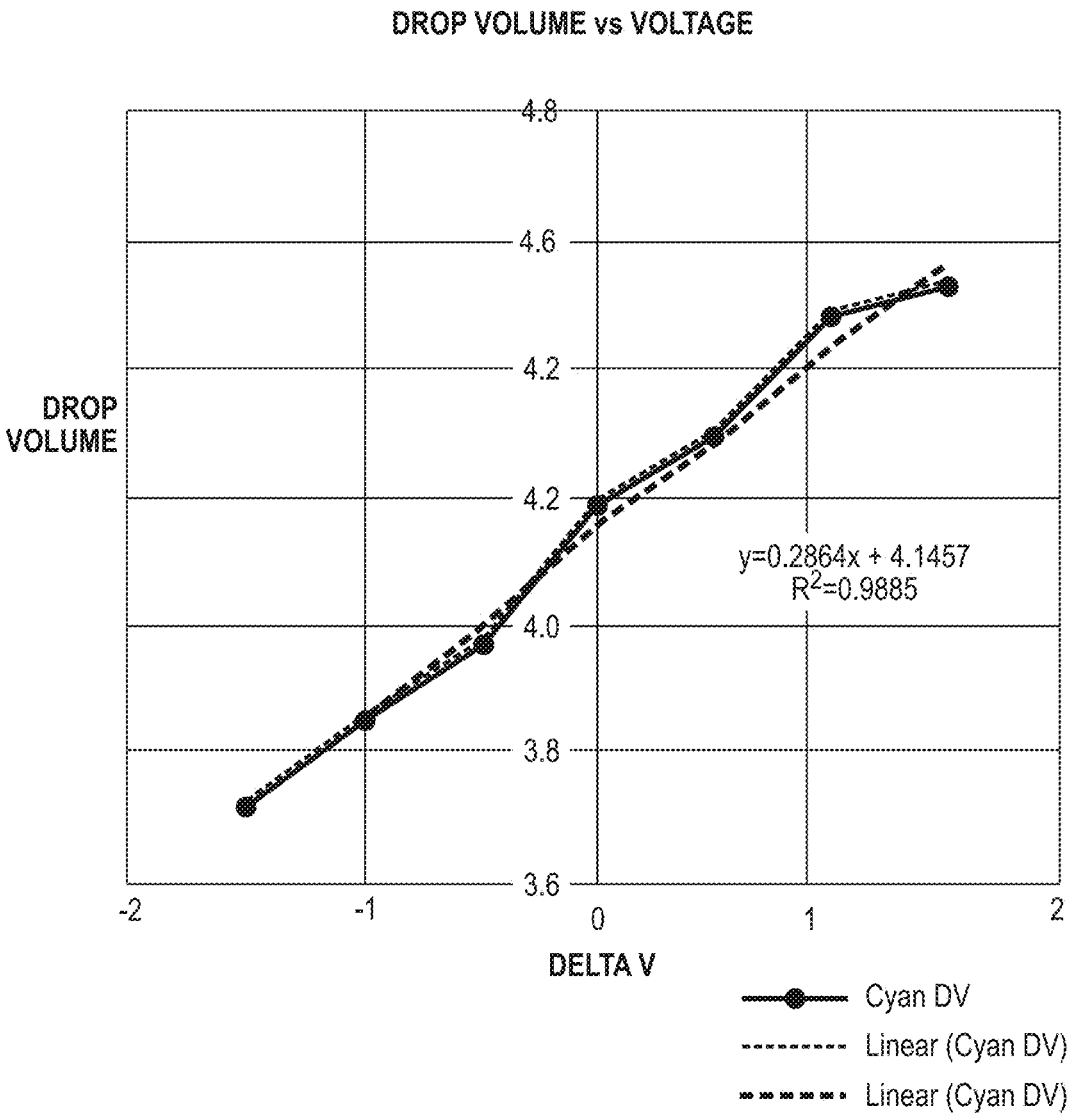
FIG. 2A, FIG. 2B, FIG. 2C, and FIG. 2D are graphs of ink drop volume versus change in peak voltage of the firing signal.
Figure 2B:
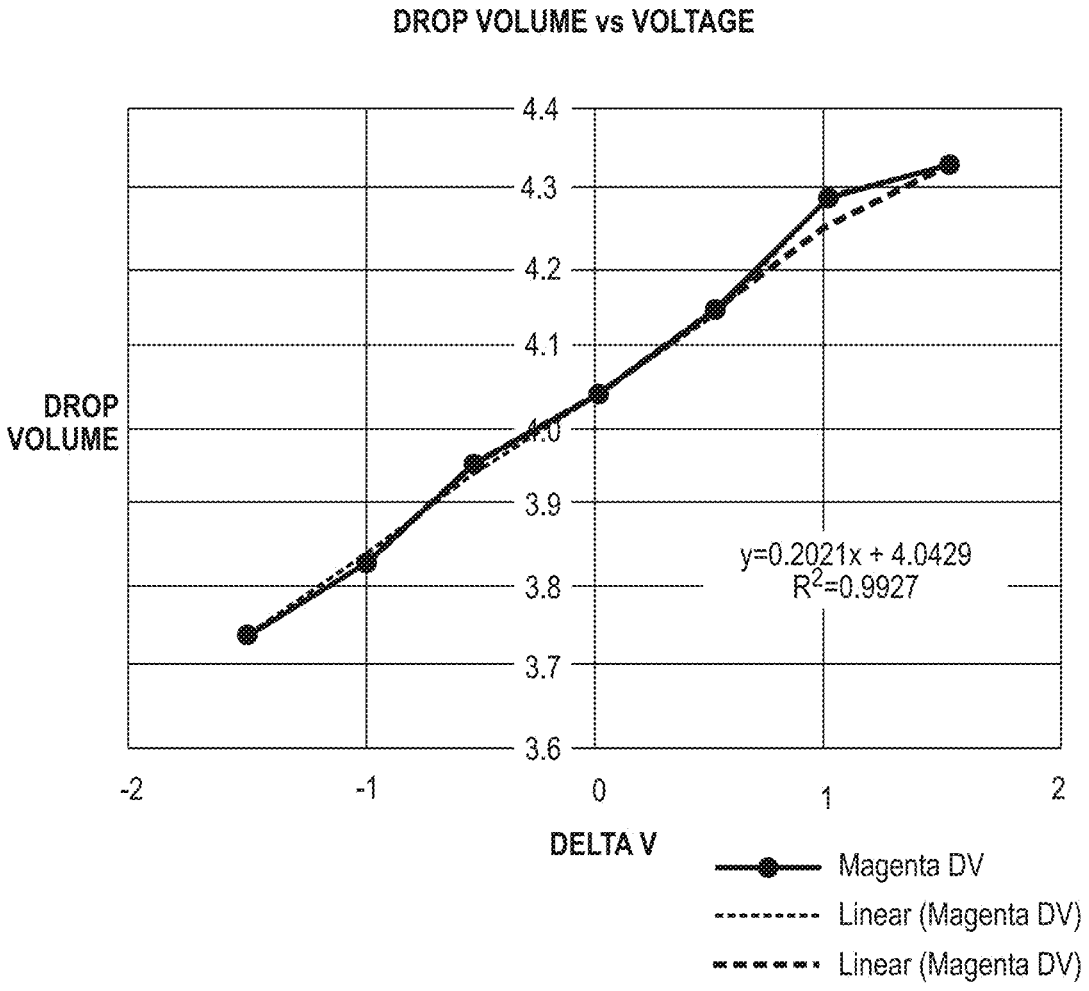
Figure 2C:
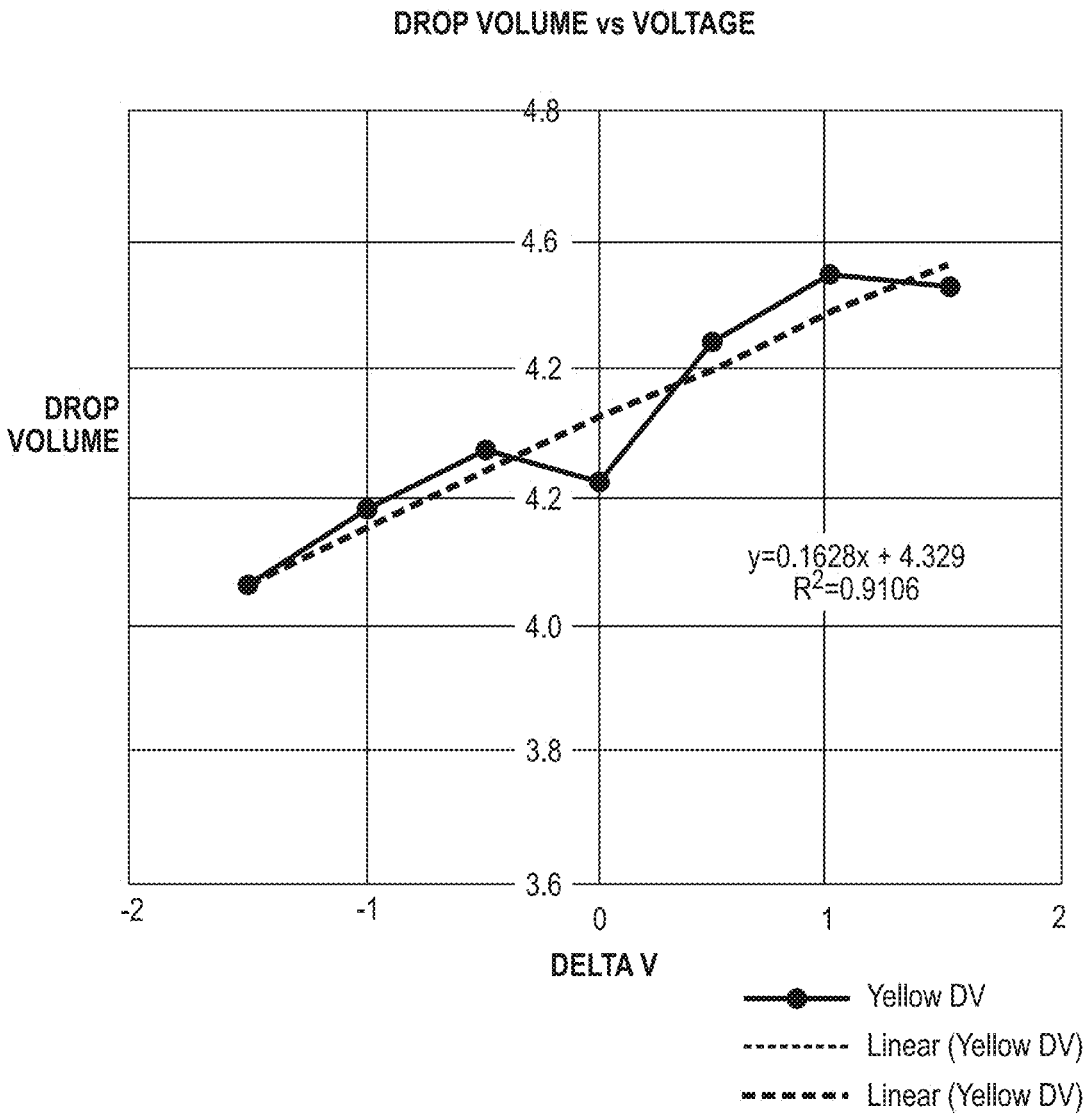
Figure 2D:
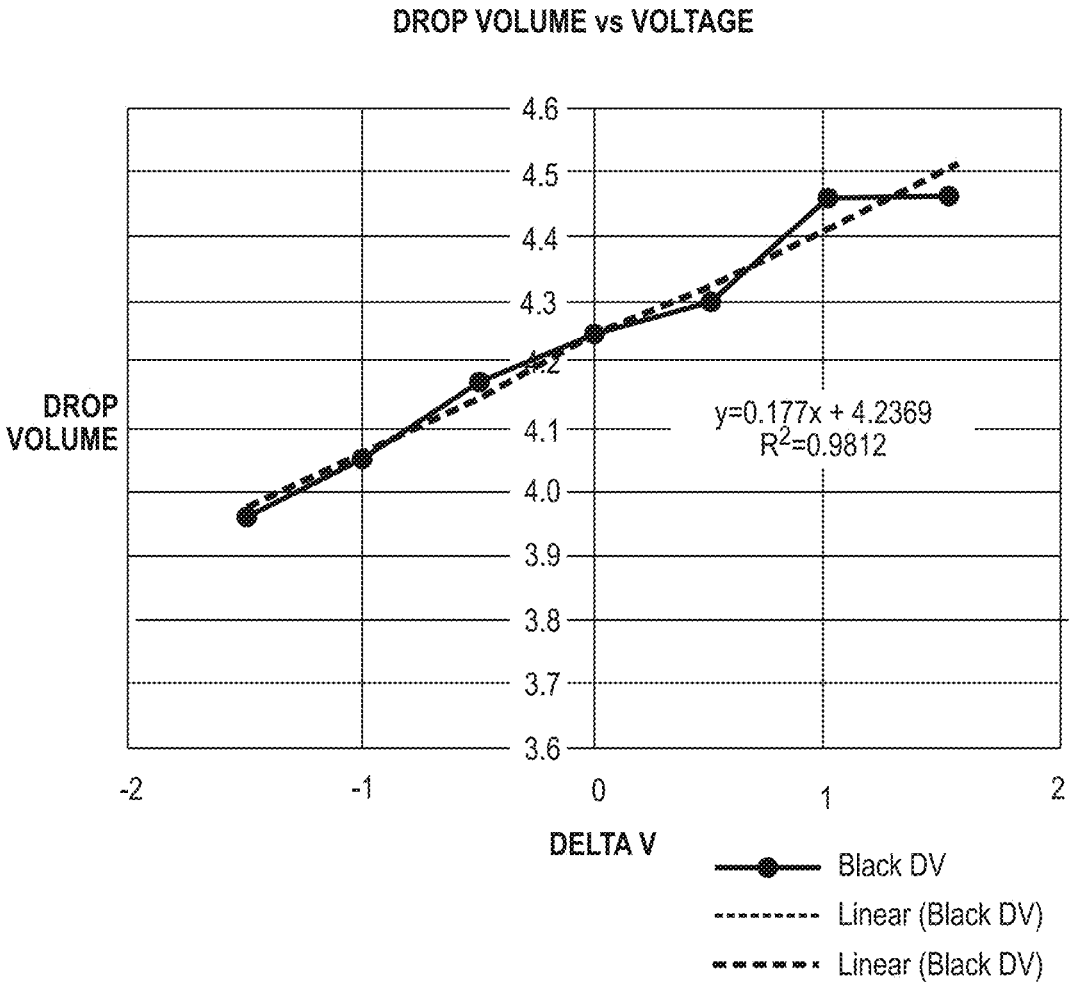

For a general understanding of the present embodiments, reference is made to the drawings. In the drawings, like reference numerals have been used throughout to designate like elements.

A printing system 10 configured to detect changes in the nominal ink drop volume produced by a printhead outside a predetermined range and restore the ability of the printhead to eject ink drops having the nominal drop volume is shown in FIG. 1. The system 10 is a web printing system in which a controller 14 operates an actuator 18 to rotate a take-up shaft 22 after the web W has been fed through the system and a portion of the web is wrapped around the shaft 22. This rotation of the shaft 22 pulls the web from the supply roll 20 and then through a print zone 26 of the printer 10. The web W continues past a plurality of dryers 34 that finish the drying of the ink ejected onto the web in print zone 26. In one embodiment, the dryers 34 are convective heaters that direct heated air against the web. The finished printed image then passes an optical sensor 24 that generates image data of the printed image so the image data can be analyzed by the controller 14 to determine whether the image quality is acceptable. The optical sensor 24 can be a single line scanner comprised of LED emitters and photodetectors or a camera that generates two dimensional images. Rollers 42 and 46 are provided to maintain tension in the web W and they can be movable to adjust the tension in the web in a known manner. The supply roll 20 can be paper, coated paper, plastic, flexible packaging, foil, and the like. Although the system and method described in this document are discussed with reference to the web inkjet printer shown in FIG. 1, the system and method can also be used in printers that print images on individual sheets that are carried by a media transport system through the printer in a manner similar to the movement of the web described above.

Four printheads, each of which ejects a different color of ink, are shown in the print zone 26. Each printhead 50A, 50B, 50C, and 50D in the print zone 26 is operatively connected to a corresponding printhead driver 54A, 54B, 54C, and 54D and the controller 14 is operatively connected to these printhead drivers. A single printhead for a single color has been depicted to simplify the figure. Typically, each color of ink is printed by an array of printheads, which are arranged in a known manner, and each printhead in an array is operatively connected to a corresponding printhead driver.

The controller 14 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

The controller 14 is operatively connected to an image source 70. Image source 70 can be a scanner, database, or other image generation or data source. An image that the controller 14 obtains from the image source 70 is used to operate the printer 10 to form an ink image on the web W corresponding to the obtained image. The controller 14 processes the image obtained from the image source in a known manner for control of the printhead drivers 54A to 54D. Specifically, a composite image is obtained from the image source 70. As used in this document, the term "composite image" refers to pixel data for each color and feature present in an image. The controller processes the composite image to produce color separation files that correspond to the colors of ink ejected by the printheads in the print zone. Additional processing can also occur in a known manner such as halftoning and the like. Each color separation file derived from the composite image is supplied to the printhead driver corresponding to the printhead in the print zone 26 that ejects the color ink corresponding to the color separation file. For example, the black color separation file derived from the composite image is delivered to the printhead driver MA, which operates the printhead 50A that ejects black ink. As used in this document, the term "print zone" means an area directly opposite a plurality of printheads that forms an ink image on a substrate using color separation files. The term "process direction" means the direction in which media moves through the print zone as the inkjets eject ink onto the sheets and the term "cross-process direction" means an axis that is perpendicular to the process direction in the plane of the media in the print zone.

In previously known printers, the inkjets in the printheads change over time and eject ink drops with volumes that are different than the nominal ink drop volumes ejected when the printer was put into service. The changes in the ink drop volumes can significantly affect the quality of the printed images. To detect these changes and restore the ability of the printheads to eject ink drops having the nominal ink drop volume, the controller is configured with new programmed instructions to operate the printheads to print test patterns and analyze the image data generated by the optical sensor of these patterns to detect whether the printheads are ejecting ink drops with volumes outside a predetermined range about the nominal ink drop volume. To restore the ability of a printhead to eject ink drops having the nominal value, a compensation parameter is identified and stored in the corresponding printhead driver to alter the operation of the printhead so it produces ink drops that correspond to grayscale values of patches printed at the manufacture of the printer. The compensation parameter can be a simple voltage change in the firing signal parameters for the printhead. For example, by changing Vpp, which is the peak voltage in the firing signal waveform, the entire waveform is scaled by a corresponding amount to adjust the volume of the ink drops being ejected.

For each printhead in a printer, the relation between firing signal peak voltage and the volume of the ink drops ejections is determined. A resulting graph for each of these relationships is shown in FIG. 2A, FIG. 2B, FIG. 2C, and FIG. 2D. The peak voltage was changed in 0.5 V increments from the peak voltage that achieves the desired nominal drop volume. Regression analysis shows that the relationships are generally linear and this linear function is depicted in each figure.

Figure 3:
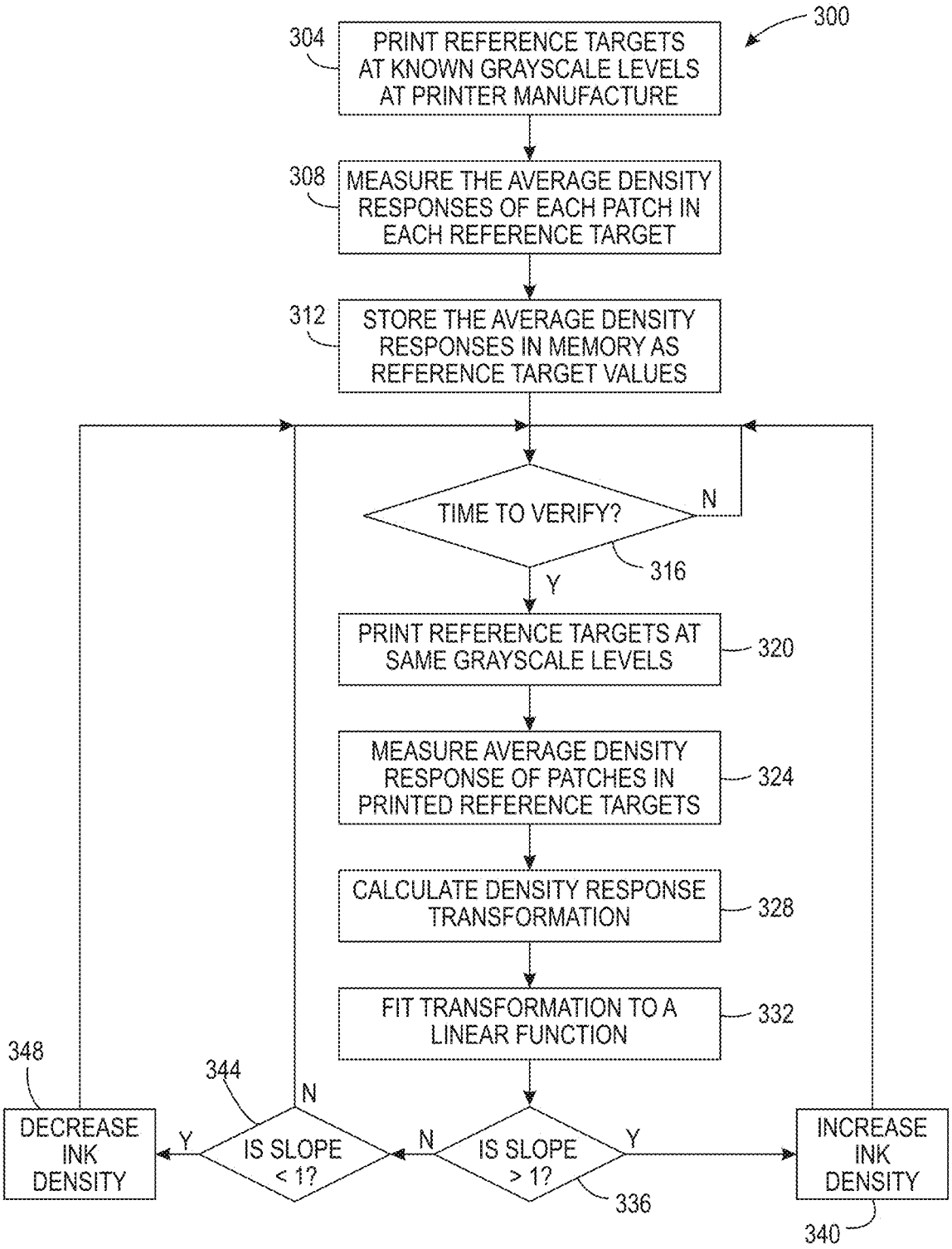
FIG. 3 depicts a process for implementing a control law within the printer of FIG. 1.

To implement with the controller a control law for modifying the peak voltage in the waveform to restore the desired nominal drop size, a process shown in FIG. 3 is performed. The process 300 begins by printing reference targets having patches at known commanded grayscale values at the time of printer manufacture when the drop volume of the head can be precisely set and measured (block 304). As used in this document, a "patch" means a polygonal shape pattern of ink drops ejected from the same printhead at a predetermined grayscale level. The average density responses of each patch in the targets are measured using an inline scanner that is integrated into the machine (block 308). These responses, $P_0(gl)$, are saved in a memory operatively connected to the controller in the printer as a reference target values, which is used for future drop size calibrations (block 312). When ink drop size calibration is performed in-situ (block 316), the same commanded gray value patch set that was printed and measured at the time of printer manufacture is printed (block 320) and the density of the responses of the patches are measured again (block 324). The current response is designated $P_t(gl)$. A transformation is then calculated (block 328). As used in this document, the term "transformation" means the modifications made to the gray level patch set, TRC(gl), that are needed to have the measured response $P_t(gl)$ match $P_0(gl)$. As noted previously, $P_0(gl)$ was captured at the time of printer manufacture. In other words, TRC(gl) needs to be found such that: $P_t(TRC(gl))=P_0(gl)$. The solution of this equation is: $TRC(gl)=P_t^{-1}(P_0(gl))$. In practice, if the commanded grayscale values of the patches are proportional to the average fraction of inkjets firing to form the patches, i.e., the halftone screen thresholds are uniformly distributed, then the TRC(gl) is nearly linear, so the solution can be fit to a linear function by: $TRC(gl)\approx\alpha*gl$, where $\alpha$ is a gain near 1, i.e., between 0.9 and 1.1 (block 332). Even if the halftone screen is not uniformly distributed, the TRC(gl) can be warped by the halftone screen distribution function to produce the TRC(gl) corresponding to an average fraction of jet firing space and fit to a linear function. If the value of a is greater than 1.0 (block 336), then more drops are needed at the current time then were printed at the time of the printer manufacture to get the same density levels (block 340). This condition implies that the ink drop volume has decreased since printer manufacture. Similarly, values of a less than 1 (block 344) imply that the ink drop volume has increased and the ink density is decreased (block 348).

Using a first order approximation that equal volumes produce near equal densities, the value of a can be used to determine how to change the ink drop size. For example, if $\alpha$ is 1.05, then to match the results obtained at the time of printer manufacture, on average 5% more inkjets need to fire. This increased number of inkjets results in 5% more ink on the page. This increase of 5% in ink volume can also be achieved by setting a new drop size that is 5% more than the current drop size and not changing the inkjet firing pattern. To the first order, these two different methods of correction are assumed to be similar in effect.

The graphs of drop volume versus voltage change shown in FIG. 2A, FIG. 2B, FIG. 2C, and FIG. 2D are used to convert the desired increase or decrease in ink density to a change in drop size by changing the peak voltage for a firing signal. Using the example depicted in the figures, an increase in the drop size of 5% for black, which is 0.225 pl for a nominal drop of 4.5 pl, the peak voltage is increased by 0.225/0.177 (0.177 is the slope indicated in the graph of FIG. 2D), which is about 1.27 V. The process can be performed iteratively until the gain a is within the above-identified predetermined margin about $\alpha=1.0$.

The control law used in this determination is: $V(k+1)=V(k)+K*(\alpha(k)-1)*D_{des}/dV_{slope}$, where V(k) is the peak voltage of the waveform, $D_{des}$ is the target drop size (e.g. 4.5 pl), $dV_{slope}$ is the local slope of change in drop volume per change in voltage for the printhead, and K is a controller gain on the drop error term. The parameter $dV_{slope}$ is determined for each printhead in the printer at the time the printer is manufactured and stored in a memory within the printer. From the graphs shown in FIG. 2C and FIG. 2B, $dV_{slope}$ varies from about 0.16 for yellow to about 0.29 for cyan. When the controller gain K is set to 1.0, then the result is a dead-beat controller, that is, it determines the input signal that needs to be applied to the printhead to bring the output (new ink drop volume) to a steady state value in the fewest number of iterations. If the determination of $dV_{slope}$ and the first order approximation of volume preservation are accurate only one iteration is needed to match the target and, thus, the desired ink drop size. The control law results in a stable system and the correction of multiple iterations converge as long as the value of $dV_{slope}$ and the ink drop volume preservation gain used in the control law calculation is more than half of the actual local slope of the system. In practice, only a few iterations, usually two or three, of the control law are needed to correct the drop size to the desired target. If the control law is not converging to the desired drop size, then the estimates of the local slopes of the drop volume versus the voltage curve may be different than when they were originally measured. In this case, reducing the gain, K, of the control law may increase the gain margin and improve system stability. Accordingly, the number of iterations for convergence to the desired peak waveform increase, but even where the gain, K, is reduced to 0.5, only about five iterations are needed to reach within 95% of the nominal ink drop size.

Figure 4:
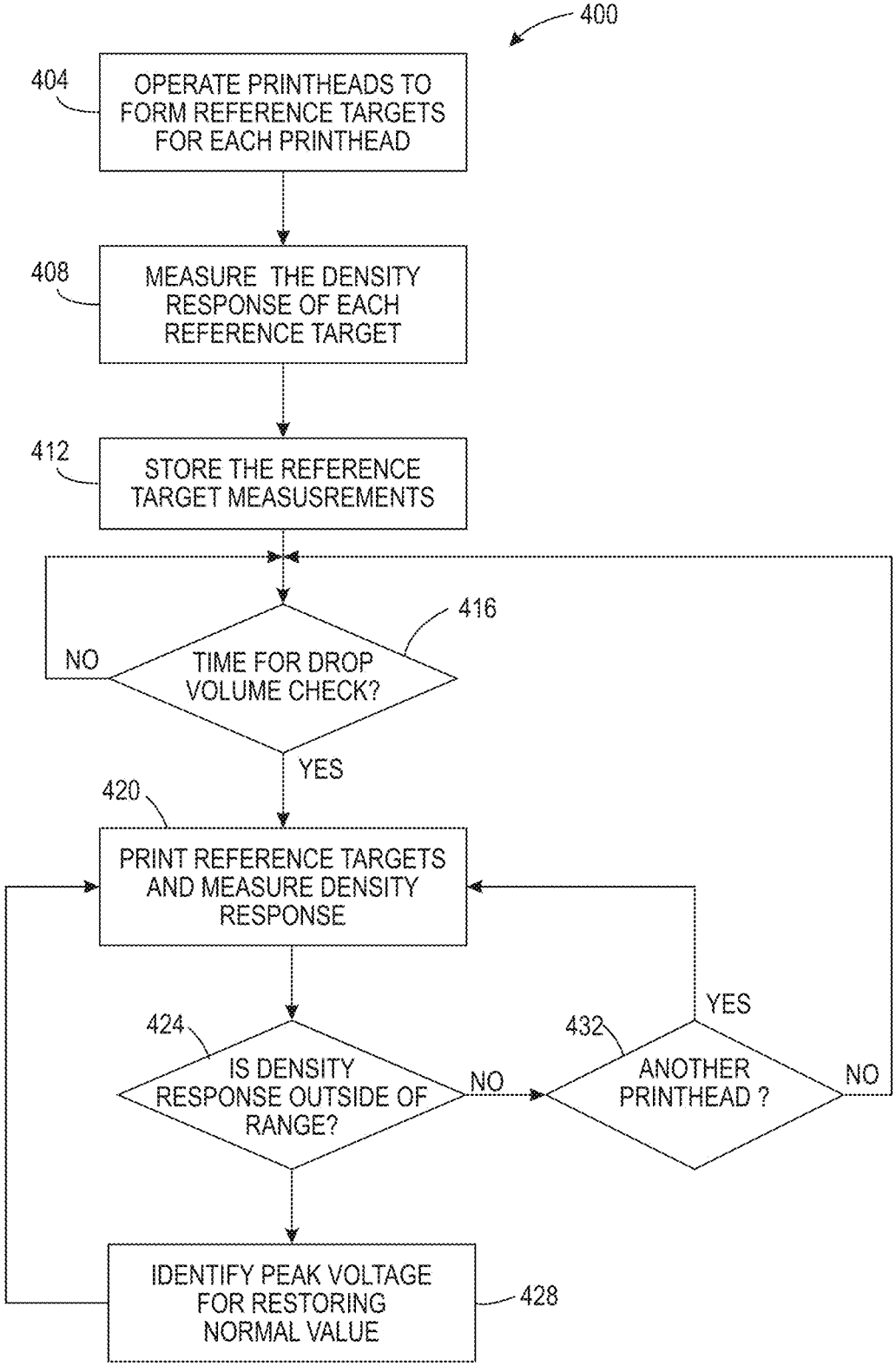
FIG. 4 depicts a process for operating the printer of FIG. 1 using the control law of FIG. 3.

A process for operating the printer shown in FIG. 1 is shown in FIG. 4. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 14 noted above can be such a controller or processor. Alternatively, the controller can be implemented with more than one processor and associated circuitry and components, each of which is configured to form one or more tasks or functions described herein.

Additionally, the steps of the method may be performed in any feasible chronological order, regardless of the order shown in the figures or the order in which the processing is described.

FIG. 4 is a flow diagram of a process 400 that operates the printing system 10 to detect changes in the nominal ink drop volume produced by a printhead outside a predetermined range and restore the ability of the printhead to eject ink drops having the nominal drop volume. The process 400 begins by operating the printheads to form the reference targets for each printhead (block 404) and measuring the density response of each reference target with the inline scanner (block 408). These responses, including the slopes of the graphs of the drop volumes versus voltage change for each printhead, are stored in a memory operatively connected to the controller (block 412). From time to time (block 416), reference targets are printed in situ and the density responses are measured (block 420). The controller then determines whether the current response is outside a predetermined range about the original response (block 424). If the response is outside the range, then, using the control law discussed above, the controller determines the peak voltage for restoring the ink drop volume produced by the printhead to within a predetermined range about the nominal value (block 428). The printing of the reference targets and measuring their responses is repeated to verify they are now within the predetermined range (blocks 416 to 420). If they are within the predetermined range, then the process checks to see if another printhead is to be evaluated (block 432) and, if it is, the process is repeated for that printhead (block 420). Otherwise, the process waits until the next time the printheads are to be evaluated (block 416).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a plurality of printheads, each printhead being configured to eject ink drops onto a substrate as the substrate passes each printhead in a process direction;

a plurality of printhead drivers, each printhead driver being configured to operate one of the printheads in the plurality of printheads in a one-to-one correspondence;

an optical sensor configured to generate image data of the substrate after the substrate has passed the plurality of printheads; and a controller operatively connected to each printhead driver and the optical sensor, the controller being configured to:

operate each of the printheads using the printhead drivers to print a pattern of ink drops on the substrate;

receive from the optical sensor the image data of the substrate;

determine whether a density response for the pattern of ink drops for each printhead is within a predetermined range about a reference density response for a pattern of ink drops printed by each printhead at a predetermined time;

identify a peak voltage for each printhead determined to have the density response outside the predetermined range, each peak voltage being identified using a peak voltage that was used to operate each of the printheads to print the pattern ink drops on the substrate; and store the identified peak voltage for each printhead having the density response outside of the predetermined range in the printhead driver corresponding to the printhead having the density response outside of the predetermined range so the printhead driver uses the identified peak voltage to generate firing signals for inkjets in the printhead operatively connected to the printhead driver.

2. The printer of claim 1, the controller being further configured to:

operate each of the printheads to form the pattern of ink drops on the substrate as at least one patch on the substrate at a predetermined grayscale level;

receive from the optical sensor image data of the at least one patch on the substrate for each printhead; and store the image data for each at least one patch on the substrate for each printhead as the reference density response for each printhead.

3. The printer of claim 2, the controller being further configured to:

operate each of the printheads to form a plurality of patches on the substrate for each printhead, each patch in the plurality of patches for each printhead being at a different grayscale level;

receive from the optical sensor image data of the plurality of patches on the substrate for each printhead; and store the image data for the plurality of patches on the substrate for each printhead as the reference density response for each printhead.

4. The printer of claim 3, the controller being further configured to:

compare image data of a plurality of patches printed by each printhead at a time subsequent to the predetermined time to the reference density response for each printhead to determine which printheads printed a plurality of patches outside the predetermined range about the reference density response for the printhead; and identify a transformation for each printhead that printed a plurality of patches outside the predetermined range that alters the image data for the plurality of patches printed by each printhead that printed a plurality of patches outside the predetermined range to correspond to the reference density response for each printhead that printed a plurality of patches outside the predetermined range.

5. The printer of claim 4, the controller being further configured to:

fit the transformation for each printhead that printed a plurality of patches outside the predetermined range to a linear function for the predetermined grayscale values used to print the plurality of patches for each printhead determined to have the density response outside the predetermined range; and identify a slope for each linear function.

6. The printer of claim 1, the controller being further configured to:

identify the peak voltage using $V(k+1)=V(k)+K*(\alpha(k)-1)*D_{des}/dV_{slope}$, where V(k) is a current peak voltage of a firing signal waveform, $D_{des}$ is a nominal ink drop size, $dV_{slope}$ is a local slope of change in drop volume per change in voltage for the printhead having the density response outside of the predetermined range, and K is a controller gain on the drop error term ($\alpha(k)-1$) where $\alpha$ is the identified slope for each linear function.

7. A method of operating a printer comprising:

operating with a controller a plurality of printhead drivers that are operatively connected to a plurality of printheads in a one-to-one correspondence to operate each printhead in the plurality of printheads to print a pattern of ink drops on a substrate as the substrate passes each printhead in a process direction;

generating with an optical sensor image data of the substrate after the pattern of ink drops has been printed on the substrate;

determining with the controller whether a density response for the pattern of ink drops for each printhead is within a predetermined range about a reference density response for a pattern of ink drops printed by each printhead at a predetermined time;

identifying with the controller a peak voltage for each printhead determined to have the density response outside the predetermined range, each peak voltage being identified using a peak voltage that was used to operate each of the printheads to print the pattern ink drops on the substrate; and storing with the controller the identified peak voltage for each printhead having the density response outside of the predetermined range in the printhead driver corresponding to the printhead having the density response outside of the predetermined range so the printhead driver uses the identified peak voltage to generate firing signals for inkjets in the printhead operatively connected to the printhead driver.

8. The method of claim 7 further comprising:

operating with the controller each of the printhead drivers to operate each of the corresponding printheads to form the pattern of ink drops on the substrate as at least one patch on the substrate at a predetermined grayscale level;

generating with the optical sensor image data of the at least one patch on the substrate for each printhead; and storing with the controller the image data for each at least one patch on the substrate for each printhead as the reference density response for each printhead.

9. The method of claim 8 further comprising:

operating with the controller each of the printhead drivers to operate each of the corresponding printheads to form a plurality of patches on the substrate for each printhead, each patch in the plurality of patches for each printhead being at a different grayscale level;

generating with the optical sensor image data of the plurality of patches on the substrate for each printhead; and storing with the controller the image data received from the optical sensor for the plurality of patches on the substrate for each printhead as the reference density response for each printhead.

10. The method of claim 9 further comprising:

comparing with the controller image data received from the optical sensor of a plurality of patches printed by each printhead at a time subsequent to the predetermined time to the reference density response for each printhead to determine which printheads printed a plurality of patches outside the predetermined range about the reference density response for the printhead; and identifying with the controller a transformation for each printhead that printed a plurality of patches outside the predetermined range that alters the image data for the plurality of patches printed by each printhead that printed a plurality of patches outside the predetermined range to correspond to the reference density response for each printhead that printed a plurality of patches outside the predetermined range.

11. The method of claim 10 further comprising:

fitting with the controller the transformation for each printhead that printed a plurality of patches outside the predetermined range to a linear function for the predetermined grayscale values used to print the plurality of patches for each printhead determined to have the density response outside the predetermined range; and identifying with the controller a slope for each linear function.

12. The method of claim 11 further comprising:

identifying with the controller the peak voltage using $V(k+1)=V(k)+K*(\alpha(k)-1)*D_{des}/dV_{slope}$, where V(k) is a current peak voltage of a firing signal waveform, $D_{des}$ is a nominal ink drop size, $dV_{slope}$ is a local slope of change in drop volume per change in voltage for the printhead having the density response outside of the predetermined range, and K is a controller gain on the drop error term ($\alpha(k)-1$) where $\alpha$ is the identified slope for each linear function.

13. A printer comprising:

a plurality of printheads, each printhead being configured to eject ink drops onto a substrate as the substrate passes each printhead in a process direction;

a plurality of printhead drivers, each printhead driver being configured to operate one of the printheads in the plurality of printheads in a one-to-one correspondence;

an optical sensor configured to generate image data of the substrate after the substrate has passed the plurality of printheads; and a controller operatively connected to each printhead driver and the optical sensor, the controller being configured to:

operate at a first time each of the printhead drivers to generate firing signals for each of the corresponding printheads in the plurality of printheads to form a first plurality of patches on the substrate for each printhead, each patch in the first plurality of patches formed by each printhead having a predetermined grayscale level;

receive from the optical sensor image data of the first plurality of patches for each printhead on the substrate;

store in a memory the image data for each patch in the first plurality of patches for each printhead on the substrate as a reference density response for each patch printed by each printhead at each predetermined grayscale level;

operate at a second time that is subsequent to the first time each of the printhead drivers to generate firing for each of the corresponding printheads in the plurality of printheads to form a second plurality of patches on the substrate for each printhead, each patch in the second plurality of patches for each printhead being printed at the predetermined grayscale levels used to print the first plurality of patches for each printhead;

receive from the optical sensor image data of the second plurality of patches on the substrate for each printhead; and determine whether a density response for each patch in the second plurality of patches for each printhead is within a predetermined range about the reference density response stored for each patch printed by each printhead at each predetermined grayscale level;

determine a compensation parameter for each printhead that printed at least one patch in the second plurality of patches having the density response that is outside the predetermined range; and store the compensation parameter in the printhead driver corresponding to the printhead that printed the at least one patch in the second plurality of patches having the density response outside of the predetermined range.

14. The printer of claim 13 wherein the compensation parameter is a peak voltage for the firing signal generated by the printhead driver in which the compensation parameter is stored.

15. The printer of claim 14, the controller being further configured to:

identify a transformation for each printhead that printed the at least one patch in the second plurality of patches outside the predetermined range, the identified transformation alters the image data for the at last one patch in the second plurality of patches printed by each printhead that printed the at least one patch in the second plurality of patches outside the predetermined range to correspond to the reference density response for the corresponding patch in the first plurality of patches for each printhead that printed a plurality of patches outside the predetermined range.

16. The printer of claim 15, the controller being further configured to:

fit the transformation for each printhead that printed the at least one patch in the second plurality of patches outside the predetermined range to a linear function; and identify a slope for each linear function.

17. The printer of claim 16, the controller being further configured to:

identify the peak voltage using $V(k+1)=V(k)+K*(\alpha(k)-1)*D_{des}/dV_{slope}$, where V(k) is a current peak voltage of a firing signal waveform, $D_{des}$ is a nominal ink drop size, $dV_{slope}$ is a local slope of change in drop volume per change in voltage for the printhead having the density response outside of the predetermined range, and K is a controller gain on the drop error term $(\alpha(k)-1)$ where $\alpha$ is the identified slope for each linear function.

* * * * *